US006083111A

United States Patent [19]

Moser et al.

[11] Patent Number: 6,083,111

[45] Date of Patent: Jul. 4, 2000

[54] METHOD AND APPARATUS FOR A TILTING FREE-FALL AND ACCELERATING AMUSEMENT RIDE

[76] Inventors: Alfeo Moser; Stefano Moser; Nicola Moser; Matria Moser; Sebastiano Moser, all of Via B. Cellini, 16, 46035 Ostiglia (MN), Italy

[21] Appl. No.: 09/212,819

[22] Filed: Dec. 16, 1998

[51] Int. Cl.[7] ..... A63G 31/10

[52] U.S. Cl. ..... 472/50; 472/131

[58] Field of Search ..... 472/49, 50, 131, 472/2, 80

[56] References Cited

U.S. PATENT DOCUMENTS

| | | | |
|---|---|---|---|
| 2,221,215 | 11/1940 | Eyerly | 472/50 |
| 3,286,373 | 11/1966 | Mangieri | 434/30 |
| 4,580,982 | 4/1986 | Ruppert | 434/30 |
| 4,973,042 | 11/1990 | Klopf et al. | 472/2 |
| 5,628,690 | 5/1997 | Spieldiener et al. | 472/131 |
| 5,632,686 | 5/1997 | Checketts | 472/131 |
| 5,704,841 | 1/1998 | Checketts | 472/131 |
| 5,893,802 | 4/1999 | Bohme | 472/131 |

*Primary Examiner*—Kien T. Nguyen

*Attorney, Agent, or Firm*—Royston, Rayzor, Vickery, Novak & Druce, L.L.P.

[57] ABSTRACT

Method and apparatus for providing a thrilling amusement ride to a passenger stemming predominantly from the inducement of a feeling of being propelled downward toward the ground and from the inducement of a feeling of falling from the ride's supporting chair. The method includes positioning a passenger in a passenger support or chair of an amusement ride in a forward facing orientation. The passenger support is located at a drop position in a pre-fall orientation. This drop position may be an origination position, or may be a position to which the support is raised. The passenger support, together with the passenger, is tilted forward into a falling orientation which is at a predetermined tilt-angle to the pre-fall orientation. The passenger support, together with the passenger, is dropped and/or propelled from the drop position to a lower position while the passenger support and the passenger are in the forward tilted falling orientation thereby providing a thrilling amusement ride to the passenger.

22 Claims, 7 Drawing Sheets

METHOD AND APPARATUS FOR A TILTING FREE-FALL AND ACCELERATING AMUSEMENT RIDE

RELATED PATENT APPLICATIONS

This patent application is a continuation-in-part of U.S. patent application Ser. No. 09/211,602 filed Dec. 14, 1998 and entitled METHOD AND APPARATUS FOR A TILTING FREE-FALL AMUSEMENT RIDE; said application in its entirety is hereby expressly incorporated by reference into the present application.

DESCRIPTION

1. Technical Field

The present invention relates generally to amusement rides, and more specifically to a tilting free-fall and optionally accelerating amusement ride that gives the passenger a feeling of dropping and/or rocketing through mid-air and slipping from the chair or car in which they are being carried.

2. Background Art

Amusement rides that take advantage of the earth's gravity to give a rider the feeling of dropping through mid-air toward the ground are known. In most known embodiments, an elevated tower is provided upon which the passenger is raised to an upper position. From that position, the carrier in which the passenger rests is permitted to drop toward the ground's surface. The drop of the carrier is controlled, but at least a portion of the travel imparts the sensation of a free-fall to the passenger. The unaccustomed free-fall feeling experienced by the passenger is awkward and exhilarating therefore creates a thrilling amusement ride.

In the conventional and known designs for free-fall amusement rides, the passenger typically is maintained in an upright, vertical sitting position throughout the ride's course.

In this position, the passenger experiences the free-fall sensation because it is communicated to him or her from the carrier in which they are sitting. During this free-fall period, however, the passenger's vision is directed substantially horizontally away from the tower and therefore no substantial visual sensation regarding the fall is experienced by the passenger. Still further, because the upright and erect seated position of the passenger provides full support throughout the ride, a feeling of security is imparted, which is contrary to the desired thrilling effect which instead requires the impartation of an insecure feeling to the passenger.

In view of the above described deficiencies associated with rider experiences produced by known designs for free-fall gravitational amusement rides, the present invention has been developed to enhance the thrilling effects of such rides and provide further benefits to the owner and rider. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed free-fall, gravitational amusement rides and incorporates several additionally beneficial features.

The conventional and known design for free-fall gravitational amusement rides has been enhanced so that a more thrilling ride is provided to the passenger. This has been primarily accomplished by adding a feature that permits the supporting chair for the passenger to be tilted forward so that a sensation is imparted causing the passenger to feel as though they are being dumped out of the seat. This removes all feelings of security which had previously been imparted when the supporting seat was maintained in an upright configuration. Still further, by tilting the passenger forward, his or her vision is directed, instead of horizontally away from the tower, downwardly toward the ground which is quickly approaching during the ride's free-fall phase of operation. In this manner, the tilted free-fall gravitational amusement ride of the present invention is made far more exhilarating and thrilling to the passenger.

The tilting gravitational free-fall and accelerating amusement ride is enhanced over known free-fall amusement rides by the incorporation of an acceleration feature utilizable in the free-fall phase of the ride. Not only is gravity relied upon as an accelerating force, but an additional accelerating force is optionally available to further enhance the thrill experienced by the rider.

In at least one embodiment, the present invention takes the form of a method for providing a thrilling amusement ride to a passenger stemming predominantly from the inducement of a feeling of dropping and/or being accelerated downwardly through the air and also falling from the ride's supporting chair. The method includes positioning a passenger in a passenger support or chair of an amusement ride in a forward facing orientation. The passenger support is located at a drop position in a pre-fall orientation. This drop position may be an origination position, or may be a position to which the support has been raised. The passenger support, together with the passenger, is tilted forward into a falling orientation which is at a predetermined tilt-angle to the pre-fall orientation. The passenger support, together with the passenger, is dropped or propelled from the drop position to a lower position while the passenger support and the passenger are in the forward tilted falling orientation thereby providing a thrilling amusement ride to the passenger. To further enhance the thrill imparted to the passenger, the passenger support may also be accelerated downwardly for a portion of the ride's drop toward the ground.

During this process, at least the tilting step induces in the passenger a sensation of falling forward out of the passenger support.

During the dropping step, the passenger and the passenger support travel through a free-fall phase, an acceleration phase and a braking phase from the drop position toward a ride termination position. The free-fall and acceleration phase have illustratively been shown to constitute approximately two-thirds of a total falling travel distance of the passenger support and the braking phase to constitute approximately one-third of the total falling travel distance of the passenger support. Alternatively, the free-fall phase may be eliminated and only a propelling phase exist prior to the braking phase.

In at least one embodiment, the passenger and the passenger support are oriented in the tilted, falling orientation during travel across the free-fall, acceleration and braking phase.

Alternatively, the passenger and the passenger support may be oriented in the tilted falling orientation during travel across the free-fall and acceleration phase, but reoriented to a braking orientation for travel across the braking phase. In this case, the braking orientation is affected by tilting the passenger and the passenger support back toward the pre-fall orientation from the falling orientation. Preferably, the braking orientation and the pre-fall orientation are like orientations of the passenger and passenger support.

For safety reasons, the tilt-angle of the passenger and the passenger support is limited based upon stress limitations of a vulnerable physical region of the passenger that is susceptible to injury when the passenger is exposed to excessive deceleration in the braking phase of travel. More specifically, the vulnerable physical region is the neck structure of the passenger.

In one embodiment, the step of locating the passenger support at the drop position in the pre-fall orientation includes raising the passenger and the passenger support from a load position to the drop position, normally in the pre-fall orientation which is a substantially upright sitting position of the passenger.

In an exemplary embodiment, the passenger support is coupled to a carriage at a pivot connection that is configured to permit the tilting of the passenger support between the pre-fall orientation and the falling orientation. In the illustrated embodiment, the pivot connection is located at a lower portion of the passenger support distantly from a head of the passenger which is positioned proximate an upper portion of the passenger support. The position of the pivot connection, however, may be at any suitable location to affect appropriate tilting of the passenger support.

A travel course for the carriage is established by engaging a guide that is connected to the carriage upon an elongate rail or track that is coupled to an elevating tower. In one embodiment, the guides include a set of wheels engaged upon the elongate track and that are configured for positive traction thereupon. A brake device is coupled to at least one wheel of the set of wheels for slowing and stopping the carriage and the passenger support relative to the elongate track. In alternative embodiments, the guides may be plates or similar structures arranged to slidingly engage the tracks for maintaining the travel course of the passenger support. The braking action may also be accomplished utilizing engageable magnets or actuable hydraulic or pneumatic cylinders, each being structures that are familiar to designers and manufacturers of such amusement rides.

In one embodiment, at least one latching mechanism is releasably engageable between the carriage and the passenger support for securing the passenger support in the pre-fall orientation when engaged and permitting tilting of the passenger support when released. An operating mechanism is coupled between the carriage and the passenger support for tilting the passenger support between the pre-fall orientation and the falling orientation.

For safety, the passenger may be secured in the passenger support utilizing a restraint that pivots into and out of engagement with the passenger's body.

The beneficial effects described above apply generally to the exemplary devices and methods disclosed herein of the tilting free-fall, gravitational amusement rides. The specific structures and steps through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed or movable relation one to the other.

As explained above, gravitational amusement rides are familiar and their construction is well known to those skilled in the art of designing and constructing the same. The components and mechanisms utilized to affect the present invention are known to those of ordinary skill in the art and their cooperations will be readily understood. Therefore, the exact structures and mechanical devices are less critical to the present invention than is the effect that is produced in a passenger 55 by the tilting gravitational and accelerating amusement ride 10. As a result, it will be assumed that those persons of ordinary skill in the art are familiar with the structures and operations of the several standard components utilized to affect the thrill and excitement experienced by a passenger 55 riding upon the tilting and accelerating gravitational amusement ride 10. Therefore, less emphasis will be placed on the description of these known structural components and greater emphasis will be placed on the claimed method for simultaneously inducing anxiety and exhilaration in the passenger 55.

Figure 1:
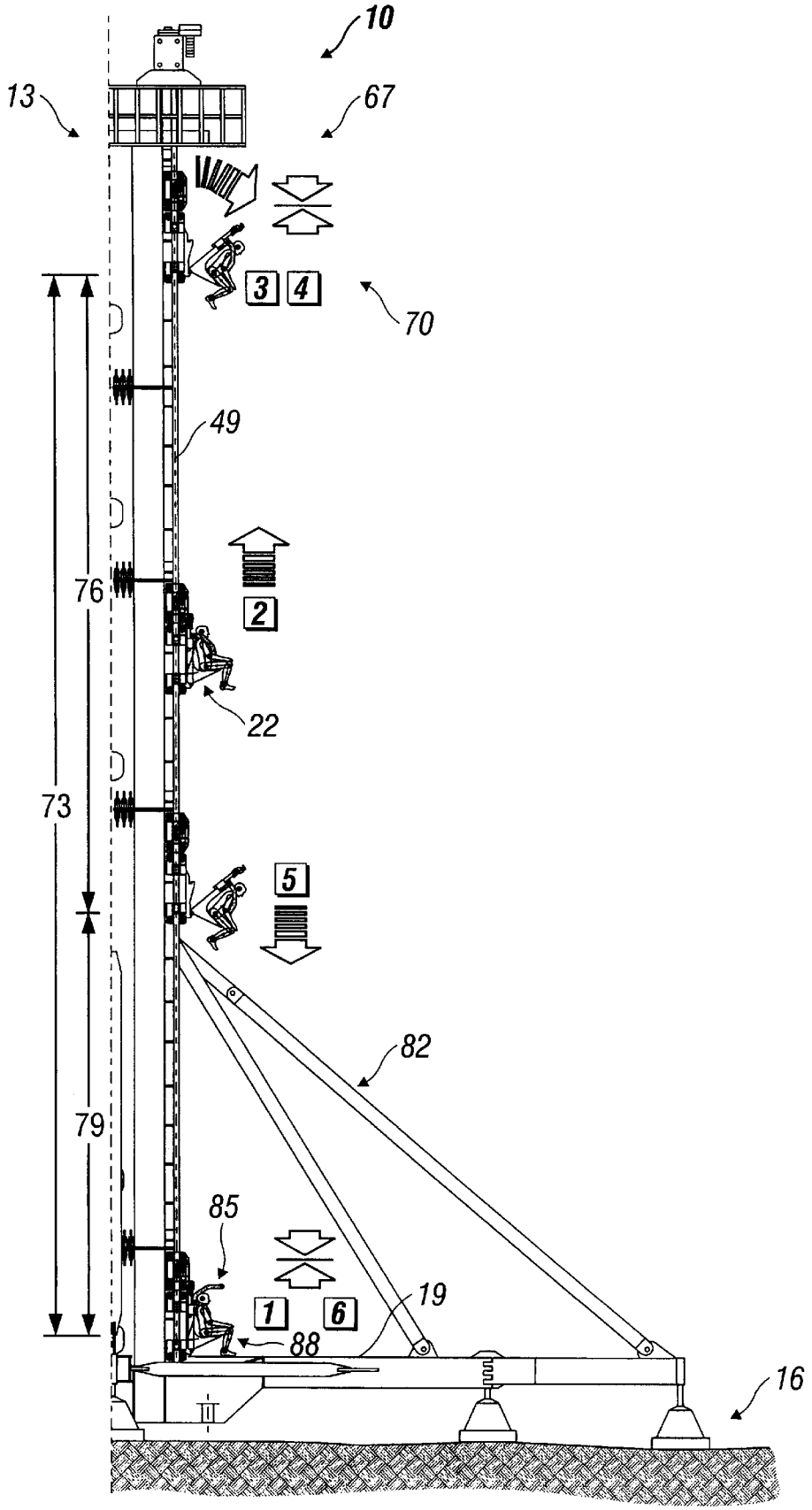
FIG. 1 is a schematic view of the free-fall and/or accelerating gravitational amusement ride illustrating the sequence of chair orientation's experienced in a cycle of the ride.
Figure 2:
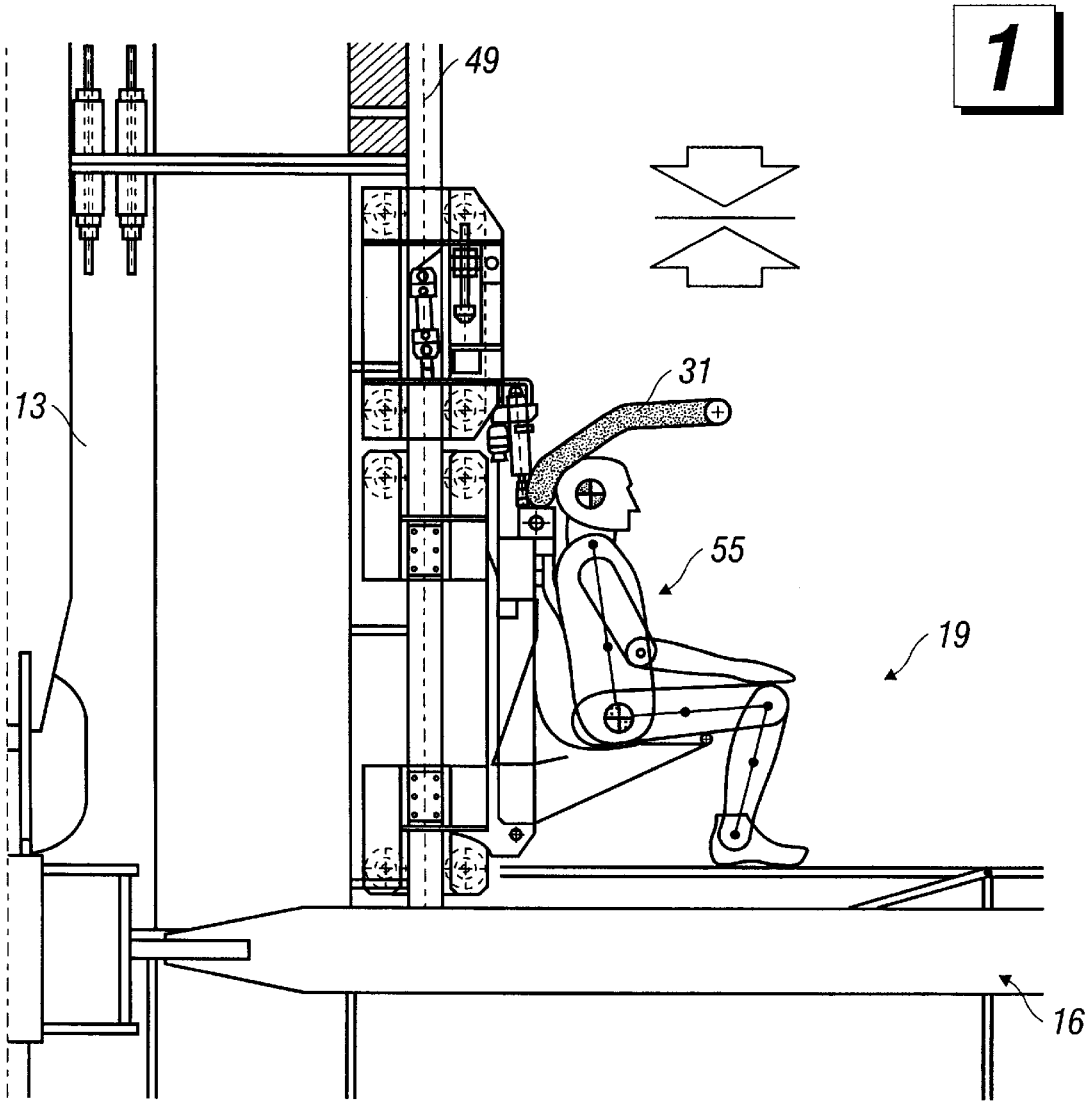
FIG. 2 is a detailed partial cutaway elevational view of the loading stage.
Figure 3:
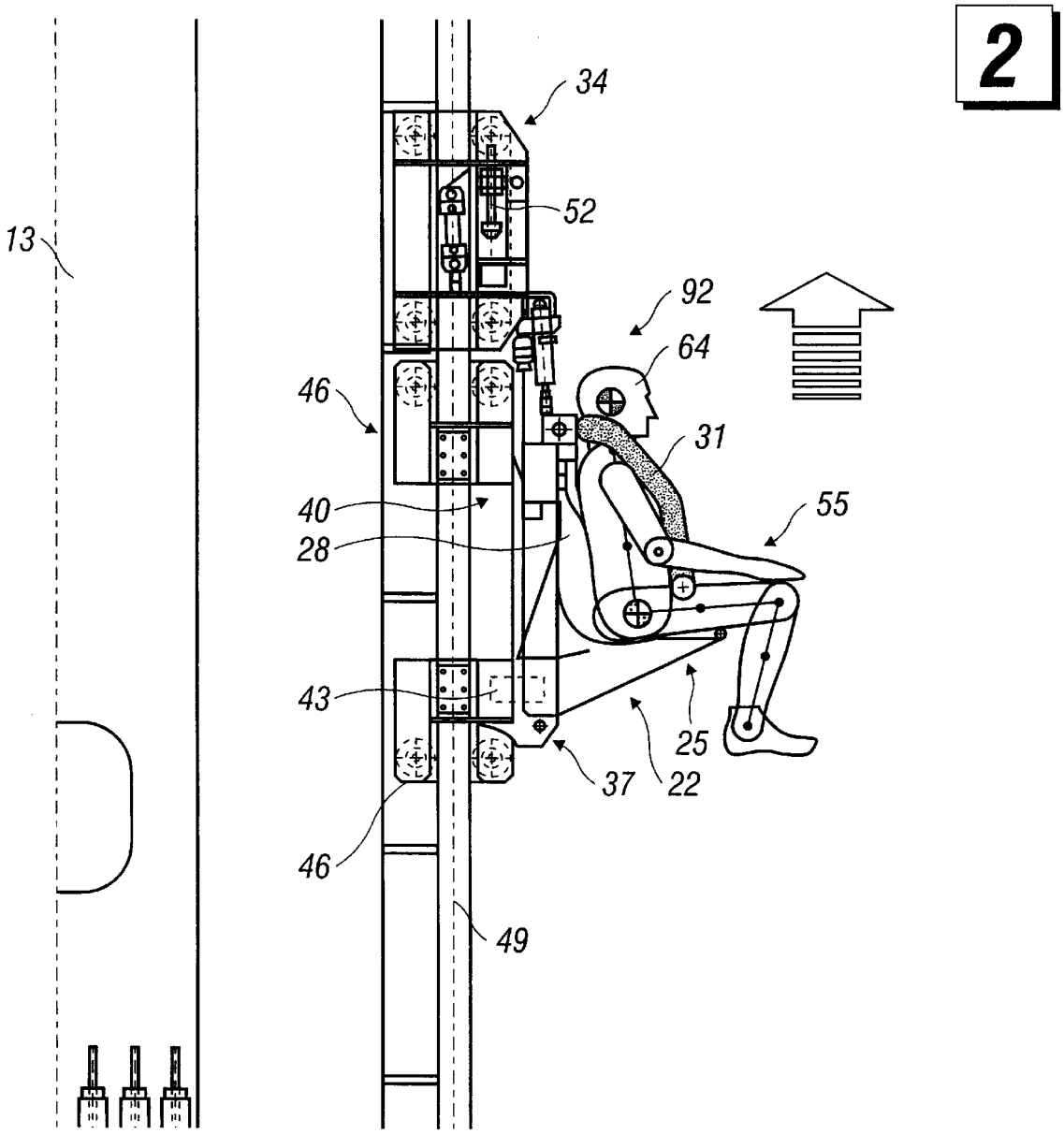
FIG. 3 is a detailed partial cutaway elevational view of a seated passenger being raised from the loading stage to the drop stage.
Figure 4:
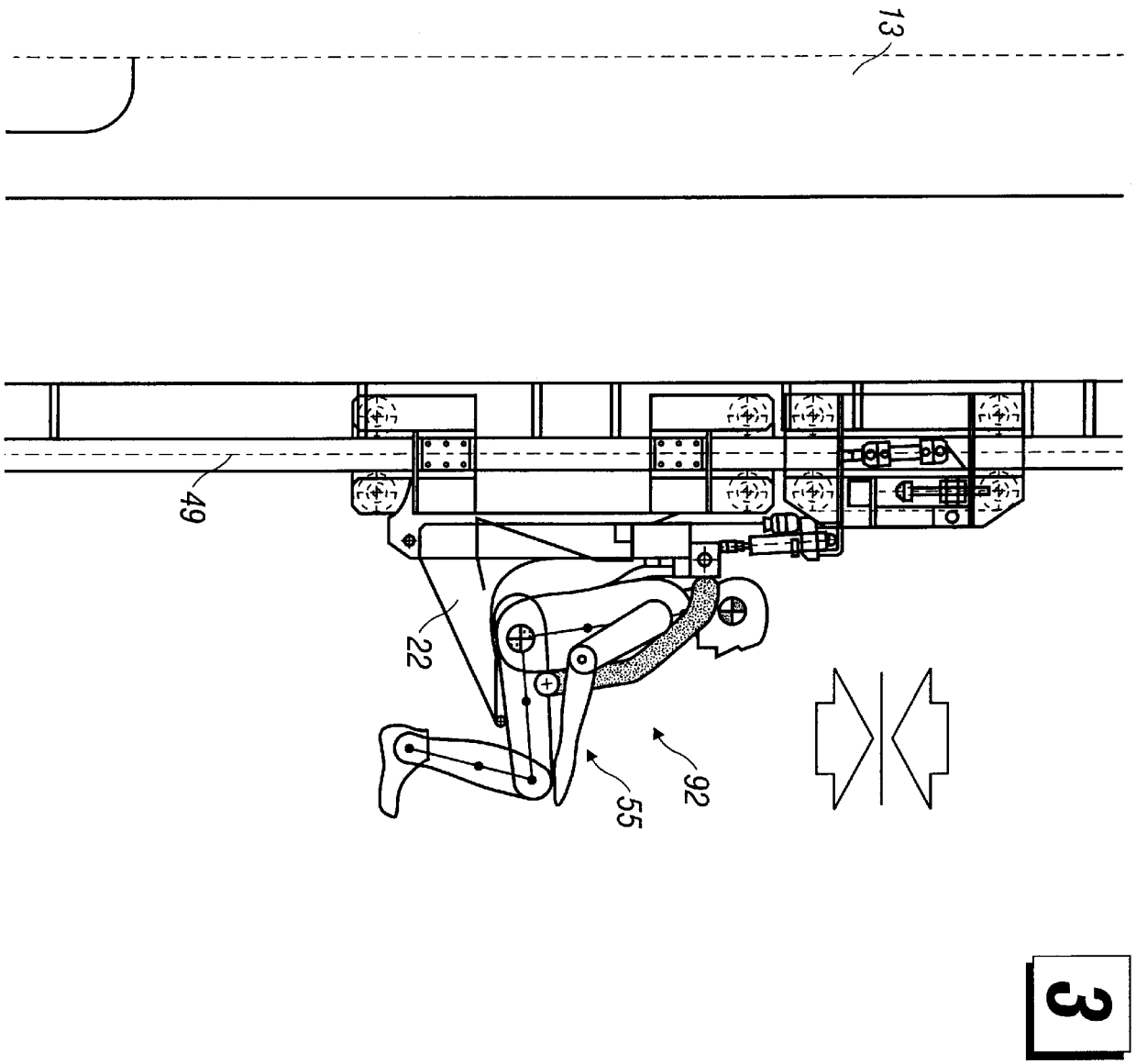
FIG. 4 is a detailed partial cutaway elevational view of a seated passenger positioned in the drop stage.

Regarding the construction of the tilting gravitational amusement ride 10, reference is made to the illustrative FIGS. 1–7. FIG. 1 illustrates not only the structure of the ride 10, but also the cycle through which a passenger 55 travels during the travel course 67 of the amusement ride 10. An elevational tower 13 is shown in an erect configuration upon a base 16 which typically rests upon and is anchored to the ground. The base 16 provides a loading station platform 19 where passengers 55 are loaded and unloaded onto and off of the ride 10. This location is also referred to as the load position 88.

As in conventionally designed gravitational amusement rides, the elevational tower 13 includes a substantially upright elongate track or rail 49 upon which a carriage 34 travels on guides 46. The carriage 34 may also be referred to as a pick-up in the amusement ride industry and the guides may be referred to as trollies. The carriage 34 has a passenger support or car 22 mounted thereupon. The passenger support 22 includes a chair-type structure upon which the passenger 55 directly rests. The chair includes a headrest, backrest and a seat for the passenger 55 to sit upon and a restraint 31 for retaining the passenger 55 safely in the support 22 throughout the ride's 10 cycle. The restraint 31 is pivotally connected at an upper portion 28 of the passenger support 22. Supplemental restraints may also be included as required or desired. The several restraints however, are of conventional design and well-known in the amusement ride arts.

Figure 5:
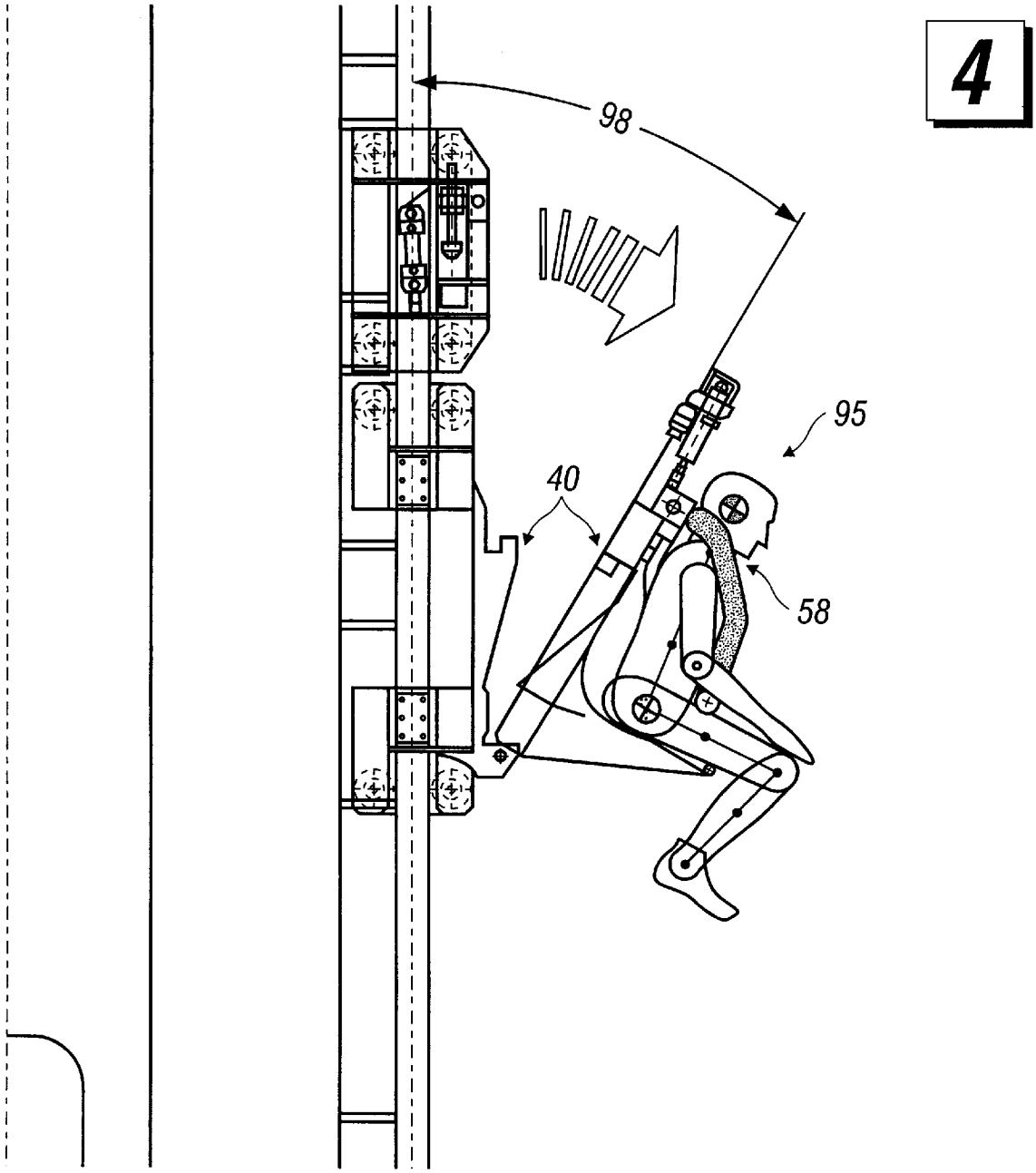
FIG. 5 is a detailed partial cutaway elevational view of the passenger and passenger support being tilted forward into the falling orientation.
Figure 6:
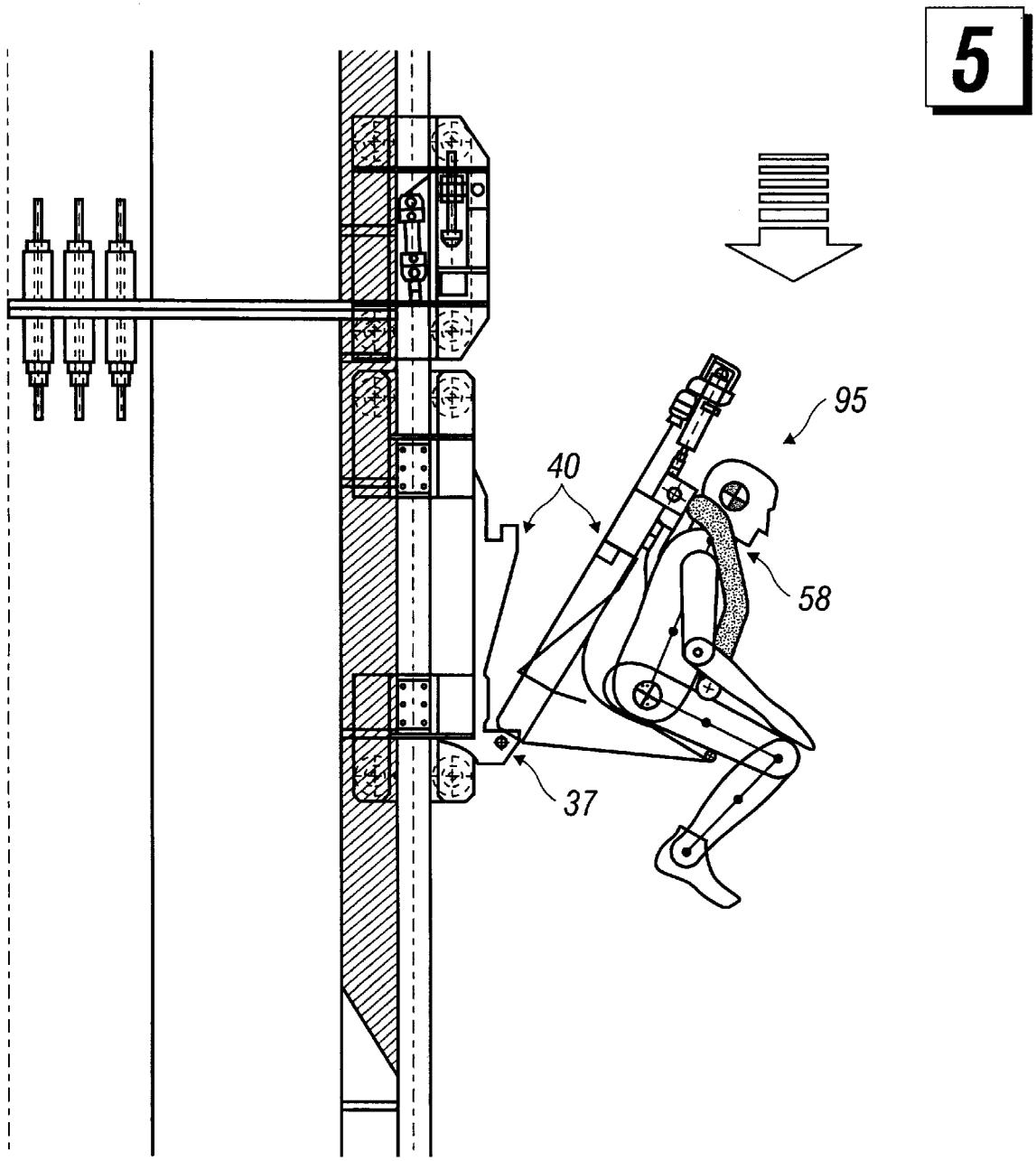
FIG. 6 is a detailed partial cutaway elevational view of the passenger and passenger support in the free-fall phase of the ride's course.
Figure 7:
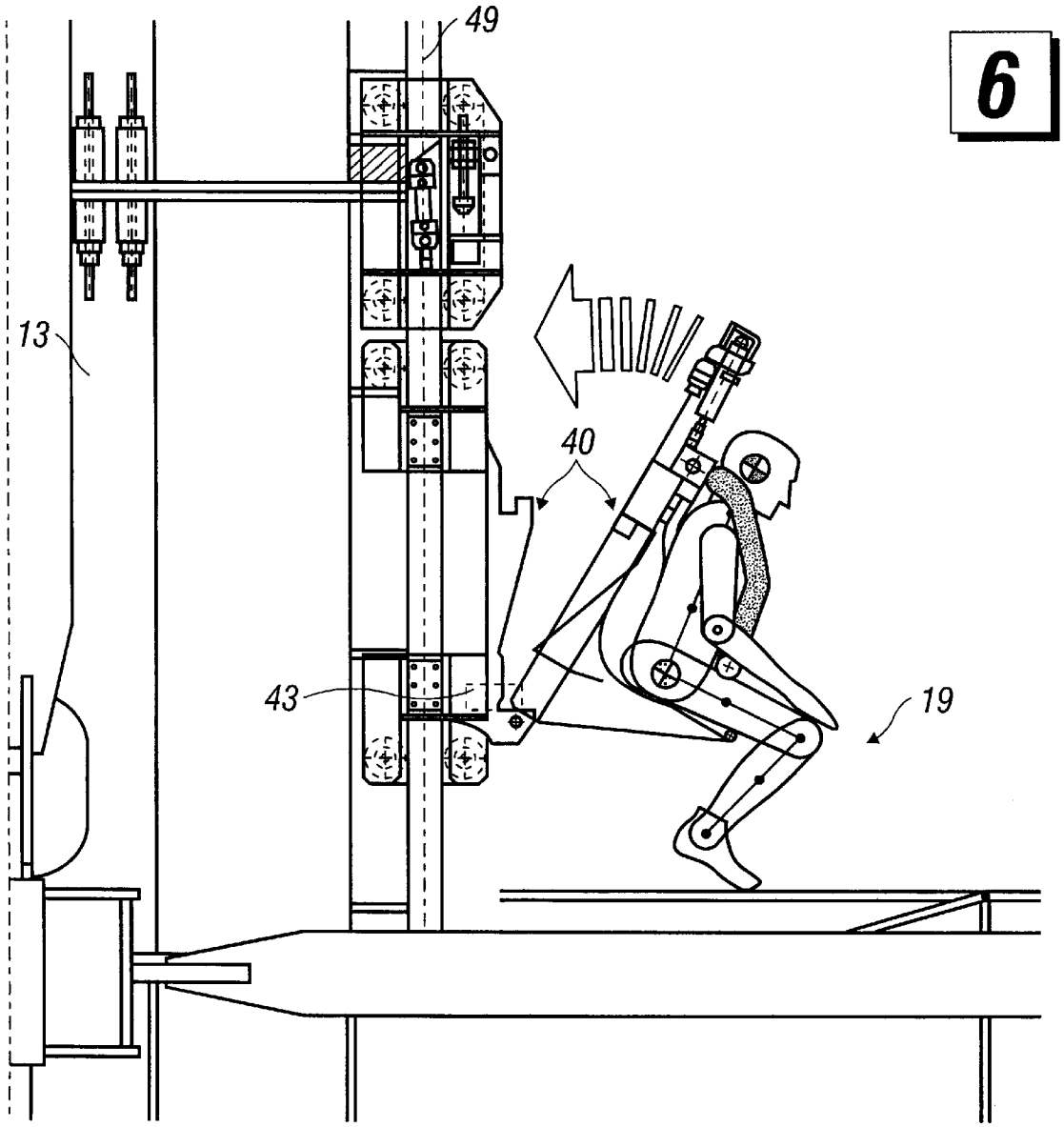
FIG. 7 is a detailed partial cutaway elevational view of the passenger and passenger support being returned to the upright orientation at the loading station.

The passenger support 22 is pivotally coupled to the carriage 34 at a lower portion 25 of the support 22. A pivot connection 37 permits the passenger support 22 and the chair carried thereupon to pivot between a substantially upright orientation, also described as a pre-fall orientation 92, and a tilted orientation which is referred to as a falling orientation 95. The degree of tilt between the pre-fall orientation 92 and the falling orientation 95 is predetermined and restricted as described herein below. This degree of tilt is also characterized as the tilt angle 98. It should be appreciated that the location of the pivot connection 37 with respect to the passenger support or car 22 is not critical, what is important is that the connection 37 facilitates proper pivotation of the support 22 during the ride about a substantially horizontal axis as illustrated in FIGS. 1, 5 and 7.

During operation, the passenger support 22 is controlled and operated between the orientations 92, 95. This operation is in part accomplished utilizing one or more releasable latching mechanisms 40 that when engaged secures the passenger support 22 in an upright position in which the passenger 55 is in a sitting position. The latching mechanism 40 is positioned between the carriage 34 and the passenger support 22. When the latching mechanism 40 is released, the passenger support 22 is permitted to tilt or be tilted from the pre-fall orientation 92 toward and into the falling orientation 95. This tilting may be permitted to occur automatically responsive to the unlatching of the latching mechanism 40 and the force of the passenger's 55 weight which is cantilevered outward a from the pivot connection 37. Alternatively, the tilting action can be induced by an operating mechanism 43 which in the described embodiment is a rotary motor and may be exemplarily electromechanical, hydraulic or other suitable configuration. The operating mechanism 43 not only controls the transformation from the pre-fall orientation 92 to the falling orientation 95, but also returns the passenger support 22 back to the upright configuration from the tilted configuration toward the conclusion of the ride's 10 cycle. When returned to the upright or pre-fall orientation 92, the latching mechanism 40 once again is engaged and that configuration is locked in until released.

A travel course 67 of the tilting gravitational amusement ride 10 takes a passenger 55 from the loading station 19 to a drop positioned 70. In the illustrated embodiment, the carriage 34 and passenger support 22 are raised from the loading station 19 to the drop position 70 which is located thereabove. Alternatively, the loading station 19 may also be at the drop positioned 70 from which the passenger 55 is dropped. In the exemplary case, however, an elevating motor is utilized to raise the passenger support 22, together with the passenger 55 up to the drop position 70.

In one embodiment, the guides 46 may take the form of sliding members or plates that slidingly engage upon the rails or tracks 49 for directing the course of travel of the carriage 34. In the illustrated embodiment, the guides 46 include sets of wheels that ride along the elongate track 49. As may be best appreciated in FIG. 2, opposed sets of wheels are provided on opposite sides of the track 49. In this way the course of travel of the carriage 34 is controlled and maintained to be substantially vertical both on the way up to the drop position 70 and back down during the exhilarating drop portion of the ride 10. A brake device 52 is provided upon the carriage 34 for controlling, slowing and stopping the carriage 34 during travel through the ride's course 67. In a preferred embodiment, the braking device includes an actuable magnet of variable power that is located at a back side of the carriage 34. The magnet is engageable with an elongate fin positioned upon the tower 13 so that upon actuation of the magnet a variable braking force is generated that is capable of slowing and stopping the carriage 34.

As explained above, a cycle of the ride 10 may begin at the elevated drop position 70, but will typically originate at the lower positioned loading station 19. The course 67 and action of the ride 10 is best appreciated in FIG. 1, and with reference to the various six configurations and positions referenced in FIG. 1 and illustrated in greater detail and FIGS. 2–7. Initially, a passenger 55 is loaded upon the chair portion of the passenger support 22 and the restraint 31 is pivoted down into place so that it is securely engaged about the passenger's 55 upper body. Supplemental or alternative restraints may also be utilized. The elevating mechanism is actuated and the carriage 34 (also called a gondola in the amusement ride industry), together with the passenger support 22 and passenger 55 is raised to the drop position 70. Along this course, the passenger 55 remains in a sitting, upright position. This portion of the ride 10 is referenced in FIG. 1 utilizing the boxed number 2 and upwardly directed arrow, a configuration that is shown in greater detail in FIG. 3.

Upon reaching the drop position 70, the passenger support 22 is permitted to tilt, or is tilted from the upright and sitting pre-fall orientation 92 to the tilted falling orientation 95. To accomplish such tilting, the latching mechanism 40 is released and the passenger 55 is either motored to the tilted position using the operating mechanism 43 or the support 22 is simply allowed to drop to the tilted position and falling orientation 95 under the passenger's 55 own weight. The method of permitting the passenger 55 to drop to the tilted position 95 produces a very thrilling sensation because the passenger 55 first feels as though they are freely tilting to a position in which they will fall out of the seat 22, and then when abruptly stopped at the tilted falling orientation 95 they will have the sensation of being propelled off of the seat 22 until the security of the restraint 31 is encountered and appreciated.

The tilting action is accommodated by the pivot connection 37 and is limited either by the operating mechanism 43 or appropriate stops. In any event, the tilting forward of the passenger 55 enhances the effects of the amusement ride 10 significantly. Initially, the tilting action imparts a feeling to the passenger 55 that he or she is being tilted out of, or dumped from the passenger support chair 22. Since the carriage 34 is at a significantly elevated location at this drop position 70, the resulting effect upon the passenger 55 is one of immediate anxiety before feeling the security of the restraint 31. Because it is experienced in the amusement ride setting, this anxiety is considered thrilling and exhilarating by the passenger 55. Either simultaneously or shortly thereafter, the carriage 34 begins to drop over a falling travel distance 73. This dropping action can be in fact free-fall, accelerated or slightly controlled using braking action. Based on the ride's input to the passenger gondola, the effect experienced by the passenger 55 will be one of free-fall or one of being propelled or rocketed toward the ground for at least a portion of the passenger's downward ride. Unlike in conventional gravitational amusement rides, the passenger 55 is now looking more directly at the ground in the tilted falling orientation 95 and appreciates the fact that the ground is quickly approaching and the effect being experienced at that time is an uncontrolled or propelled falling directly theretoward. The enhancement provided by the tilting action of the amusement ride 10 of the present invention is significant and potentiates the anxiety, thrill and excitement experienced by the passenger 55.

Before the carriage 34 reaches the ground, it is controllably braked so that the passenger 55 is comfortably returned to the loading position 19. Because this braking action imparts significant deceleration in the passenger 55, it is considered to be the critical portion of the ride 10. In the tilted falling orientation 95, a passenger 55 can suffer injury to the neck region or structure 58 if too great of a deceleration force is imposed. The vulnerability of the neck region 50 stems from the fact that the comparatively heavy head 64 has substantial inertia induced by the falling action of the free fall phase 76 of the falling travel distance 73. Therefore, deceleration of the carriage 34 and passenger 55 must be carefully initiated and controlled during the braking phase 79 of the travel distance 73.

In the illustrated embodiment, the free-fall and/or accelerated phase 76 accounts for approximately two-thirds of the falling travel distance 73 and the braking phase 79 accounts for approximately one-third of the falling travel distance 73. Any portion of the free-fall and/or accelerated phase 76 may actual encompass propelled or accelerated travel of the carriage 34. Downward propulsion may be supplied for only a portion of the phase 76, or it may be supplied during the entirety of the phase 76 until the braking phase 79 commences. In an exemplary embodiment, the same magnet assembly utilized to accomplish the braking effect may be oppositely utilized for accelerating the carriage 34 as desired.

The braking phase 79 concludes toward a lower position 82 and ends in a ride termination position 85. In the illustrated embodiment, the ride termination position 85 coincides with the load position 88 and occurs at the loading station or platform 19.

The tilt angle 98 must be controlled so as to prevent injury to the passenger 55 during the braking phase 79 of the travel course 67 of the tilting gravitational amusement ride 10 as described. The maximum safe tilt angle 98 is experimentally determined and then the actual tilt angle 98 is restricted within a range between that determined angle and the upright position. This orientation may be best appreciated in FIG. 5 that illustrates the tilting action at the drop position 70 experienced either prior to or simultaneously with that dropping of the carriage 34 and passenger 55 into the free-fall phase 76 of the falling travel distance 73.

At the conclusion of the travel course 67, the passenger support 22 and passenger 55 are together tilted back to be upright orientation 92 from the tilted falling orientation 95. This return to the upright position is illustrated in FIG. 7 and is accomplished using the operating mechanism 43. In this manner, the passenger is returned to be familiar sitting position and is re-oriented for discharge from the ride 10.

A tilting free-fall, gravitational amusement ride and its method of operation has been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A method for providing a tilting gravitational amusement ride to a passenger, said method comprising:

positioning a passenger in a passenger support of an amusement ride in a forward facing orientation;

locating said passenger support at a drop position in a pre-fall orientation;

tilting said passenger support, together with said passenger, forward into a falling orientation, said falling orientation being at a predetermined tilt-angle to said pre-fall orientation;

dropping said passenger support, together with said passenger, from said drop position to a lower position while said passenger support and said passenger are in said forward tilted falling orientation thereby providing a thrilling amusement ride to said passenger; and accelerating said passenger support during at least a portion of the dropping step so that said passenger experiences a sensation of being propelled toward the ground.

2. The method as recited in claim 1, wherein said tilting step further comprises:

inducing in said passenger a sensation of falling forward out of said passenger support.

3. The method as recited in claim 1, said dropping step further comprising:

said passenger and said passenger support traveling through an acceleration phase and a braking phase from said drop position toward a ride termination position.

4. The method as recited in claim 3, further comprising:

said acceleration phase constitutes approximately two-thirds of a total falling travel distance of said passenger support and said braking phase constitutes approximately one-third of said total falling travel distance of said passenger support.

5. The method as recited in claim 3, further comprising:

said acceleration phase constitutes at least one-half of a total falling travel distance of said passenger support.

6. The method as recited in claim 3, further comprising:

said passenger and said passenger support being oriented in said tilted falling orientation during travel across said acceleration phase and said braking phase.

7. The method as recited in claim 3, further comprising:

said passenger and said passenger support being oriented in said tilted falling orientation during travel across said acceleration phase; and said passenger and said passenger support being oriented in a braking orientation during travel across said braking phase.

8. The method as recited in claim 7, further comprising:

said braking orientation being affected by tilting said passenger and said passenger support back toward said pre-fall orientation from said falling orientation.

9. The method as recited in claim 7, further comprising:

said braking orientation and said pre-fall orientation being like orientations of said passenger and passenger support.

10. The method as recited in claim 1, further comprising:

limiting said tilt-angle of said passenger and said passenger support based upon stress limitations of a vulnerable physical region of said passenger, said vulnerable physical region being susceptible to injury when said passenger is exposed to excessive deceleration in said braking phase of said travel.

11. The method as recited in claim 10, wherein said vulnerable physical region is the neck structure of said passenger.

12. The method as recited in claim 1, wherein said step of locating said passenger support at said drop position in said pre-fall orientation further comprises:

raising said passenger and said passenger support from a load position to said drop position in said pre-fall orientation.

13. The method as recited in claim 12, wherein said pre-fall orientation comprises a substantially upright sitting position of said passenger.

14. A method for providing a tilting gravitational amusement ride to a passenger, said method comprising:

positioning a passenger in a passenger support of an amusement ride in a forward facing orientation;

locating said passenger support at a drop position in a pre-fall orientation;

tilting said passenger support, together with said passenger, forward into a falling orientation, said falling orientation being at a predetermined tilt-angle to said pre-fall orientation;

dropping said passenger support, together with said passenger, from said drop position to a lower position while said passenger support and said passenger are in said forward tilted falling orientation thereby providing a thrilling amusement ride to said passenger;

accelerating said passenger support during at least a portion of said dropping step so that said passenger experiences a sensation of being propelled toward the ground; and coupling said passenger support to a carriage at a pivot connection, said pivot connection configured to permit said tilting of said passenger support between said pre-fall orientation and said falling orientation.

15. The method as recited in claim 14, further comprising:

locating said pivot connection at a lower portion of said passenger support distantly from a head of said passenger, said head of said passenger being positioned proximate an upper portion of said passenger support.

16. The method as recited in claim 14, further comprising:

establishing a travel course for said carriage by engaging a guide connected to said carriage upon an elongate track coupled to an elevating tower.

17. The method as recited in claim 16, further comprising:

a brake device coupled to said passenger support for slowing and stopping said carriage and said passenger support relative to said elongate track, said brake device being a variable strength magnet engageable with a fin on said elevating tower.

18. The method as recited in claim 14, further comprising:

a latching mechanism releasably engageable between said carriage and said passenger support for securing said passenger support in said pre-fall orientation when engaged and permitting tilting of said passenger support when released.

19. The method as recited in claim 14, further comprising:

an operating mechanism coupled between said carriage and said passenger support for tilting said passenger support between said pre-fall orientation and said falling orientation.

20. A tilting accelerating gravitational amusement ride for a passenger comprising:

an elevational tower having at least a portion that is substantially vertically oriented;

a carrier engaged upon said elevational tower, said carrier adapted for substantially vertical travel relative to said elevational tower and at least a portion of said carrier's travel being through an acceleration phase of travel;

a passenger support coupled to said carrier by a tilting connection, said tilting connection adapted to accommodate limited forward pivotation of said passenger support relative to said carrier so that said passenger support is transformable between a substantially upright pre-fall orientation and a forward tilted falling orientation; and a acceleration device for accelerating said passenger support in a downward direction and a braking device of slowing and stopping travel of said passenger support.

21. A method for providing a tilting gravitational amusement ride to a passenger, said method comprising:

positioning a passenger in a passenger support of an amusement ride in a forward facing orientation;

locating said passenger support at a drop position in a pre-fall orientation;

pivoting said passenger support about a substantially horizontal axis, together with said passenger, forward into a falling orientation, said falling orientation being at a predetermined tilt-angle to said pre-fall orientation;

dropping said passenger support, together with said passenger, from said drop position to a lower position while said passenger support and said passenger remain in said forward tilted falling orientation thereby providing a thrilling amusement ride to said passenger; and accelerating said passenger support downward during at least a portion of said dropping step so that said passenger experiences a sensation of being propelled toward the ground.

22. The method as recited in claim 21 wherein said step of accelerating said passenger support downward during at least a portion of said dropping step is in addition to a gravitational downward acceleration.

* * * * *